US011998796B2

(12) United States Patent
Luo et al.

(10) Patent No.: US 11,998,796 B2
(45) Date of Patent: Jun. 4, 2024

(54) TREADMILL

(71) Applicant: Jiangxi EQI Industrial Co.Ltd, Jiujiang (CN)

(72) Inventors: Xietong Luo, Jiangxi (CN); Zhanfei He, Jiangxi (CN)

(73) Assignee: JIANGXI EQI INDUSTRIAL CO. LTD, Jiujiang (CN)

( * ) Notice: Subject to any disclaimer, the term of this patent is extended or adjusted under 35 U.S.C. 154(b) by 370 days.

(21) Appl. No.: 17/539,221

(22) Filed: Dec. 1, 2021

(65) Prior Publication Data

US 2023/0136863 A1 May 4, 2023

(30) Foreign Application Priority Data

Nov. 2, 2021 (CN) ..... 202111289842.X

(51) Int. Cl.
*A63B 22/02* (2006.01)
*A63B 22/00* (2006.01)

(52) U.S. Cl.
CPC ..... *A63B 22/02* (2013.01); *A63B 22/0046* (2013.01)

(58) Field of Classification Search
CPC ..... A63B 22/02; A63B 22/0046
See application file for complete search history.

(56) References Cited

U.S. PATENT DOCUMENTS

2009/0042698 A1 2/2009 Wang
2009/0111666 A1 4/2009 Wang

FOREIGN PATENT DOCUMENTS

CN 106861123 A 6/2017
CN 108619662 A * 10/2018 ..... A63B 22/02
CN 108619662 A 10/2018
CN 108939410 A * 12/2018
CN 209048989 U 7/2019
CN 110860063 A 3/2020
(Continued)

OTHER PUBLICATIONS

The extended European Search Report of EP Application No. 21211856.6 issued on May 27, 2022.
(Continued)

*Primary Examiner* — Sundhara M Ganesan
*Assistant Examiner* — Jacqueline N L Loberiza
(74) *Attorney, Agent, or Firm* — Andrew C. Cheng

(57) ABSTRACT

A treadmill includes an interaction assembly, a support assembly and a base assembly. A locking mechanism is provided at a pivot position between the support assembly and the base assembly. The locking mechanism can switch between an active state and a locking state. The treadmill is provided with an operating mechanism, a connecting mechanism and a driving mechanism which are connected sequentially. The operating mechanism is provided on the interaction assembly. The connecting mechanism is provided on the support assembly. The driving mechanism is provided at a pivot position between the support assembly and the base assembly. When the interaction assembly is rotated to switch from a use state to a non-use state, the connecting mechanism is driven by the operating mechanism and then the driving mechanism is driven by the connecting mechanism, so as to cause the locking mechanism to switch from the locking state to the active state.

18 Claims, 8 Drawing Sheets

(56) References Cited

FOREIGN PATENT DOCUMENTS

| | | | |
|---|---|---|---|
| CN | 212679956 | U | 3/2021 |
| WO | 2021031657 | A1 | 2/2021 |

OTHER PUBLICATIONS

The Search Report of CN Application No. 202111289842.X issued on Jun. 14, 2022.
The Office Action of CN Application No. 202111289842.X issued on Jun. 14, 2022.

* cited by examiner

TREADMILL

CROSS-REFERENCE TO RELATED APPLICATION

The present invention is based on and claims the priority of Chinese patent application No. 202111289842.X, filed on Nov. 2, 2021. The contents of the above-identified application are incorporated herein by reference.

TECHNICAL FIELD

The present invention relates to the technical field of fitness equipment, and in particular, to a treadmill.

BACKGROUND OF THE INVENTION

With the improvement of people's living standards, treadmill has gradually become one of people's favorite fitness equipment because of its simple operation and good exercise effect. At present, there are two types of treadmills, i.e., fixed type and folding type. Folding has increasingly become a necessary function for a treadmill, especially for a household treadmill, because it is convenient for transportation and placement. However, looking at the folding treadmill on the market at present, although it has been continuously improved, the folding operation is still complex and cumbersome, and the safety is not high, which makes the user's use experience poor.

The foregoing description is intended to provide general background information and does not necessarily constitute prior art.

SUMMARY OF THE INVENTION

In view of the above, the present invention aims to provide a treadmill with convenient and safe folding operation.

The present invention provides a treadmill including an interaction assembly, a support assembly and a base assembly. The interaction assembly is pivotally connected with an upper end of the support assembly such that the interaction assembly can rotate relative to the support assembly and switch between a use state and a non-use state. A lower end of the support assembly is pivotally connected with the base assembly such that the support assembly can rotate relative to the base assembly and switch between an unfolding state and a folding state. A locking mechanism is provided at a pivot position between the support assembly and the base assembly, the locking mechanism can switch between an active state and a locking state; in the active state, the support assembly can rotate relative to the base assembly, and in the locking state, the support assembly cannot rotate relative to the base assembly. The treadmill is provided with an operating mechanism, a connecting mechanism and a driving mechanism which are connected sequentially, the operating mechanism is provided on the interaction assembly, the connecting mechanism is provided on the support assembly, the driving mechanism is provided at a pivot position between the support assembly and the base assembly. When the interaction assembly is rotated to switch from the use state to the non-use state, the connecting mechanism is driven by the operating mechanism and then the driving mechanism is driven by the connecting mechanism, so as to cause the locking mechanism to switch from the locking state to the active state.

Further, the locking mechanism includes a first locking member and a second locking member, the first locking member is provided on the support assembly, the second locking member is provided on the base assembly; in the active state, the first locking member is unlocked with the second locking member such that the support assembly can rotate relative to the base assembly; in the locking state, the first locking member is locked with the second locking member such that the support assembly cannot rotate relative to the base assembly.

Further, the first locking member and the second locking member are provided with a concave-convex matching structure; in the active state, the first locking member is located far away from the second locking member and the concave-convex matching structure is disengaged from each other such that the first locking member is unlocked with the second locking member; in the locking state, the first locking member is located close to the second locking member and the concave-convex matching structure is engaged with each other such that the first locking member is locked with the second locking member. However, the locking between the first locking member and the second locking member may also be achieved by other structures other than the concave-convex matching structure. For example, the first locking member and the second locking member may be clamped to each other.

Further, one of the first locking member and the second locking member is provided with at least one protrusion, the other of the first locking member and the second locking member is provided with at least one insertion hole, the at least one protrusion corresponds to the at least one insertion hole to form the concave-convex matching structure; in the active state, the at least one protrusion is disengaged from the at least one insertion hole such that the first locking member is unlocked with the second locking member; in the locking state, the at least one protrusion is engaged in the at least one insertion hole such that the first locking member is locked with the second locking member.

Further, the first locking member includes a first plate body, the first plate body is provided with a limiting post, the second locking member includes a second plate body, the second plate body is provided with a first limiting block and a second limiting block, the limiting post is cooperated with the first limiting block and the second limiting block to limit a rotation range of the support assembly relative to the base assembly, such that the support assembly can only rotate and switch between the unfolding state and the folding state. However, other structures may also be used to limit the rotation range of the support assembly relative to the base assembly.

Further, the driving mechanism includes an elastic member, a first wedge and a second wedge for cooperating with the first wedge, the first wedge is connected to and driven by the connecting mechanism to move together with the connecting mechanism, the second wedge is fixed on the first locking member, the elastic member is configured to exert a biasing force on the first locking member; when the first wedge is driven to move in a first direction relative to the second wedge, the biasing force drives the first locking member to move away from the second locking member such that the first locking member is unlocked with the second locking member; when the first wedge is driven to move in an opposite second direction relative to the second wedge, the first wedge drives the second wedge and the first locking member to move towards the second locking member such that the first locking member is locked with the second locking member.

Further, the first wedge is provided with a first wedge portion facing inwards, an elongated slot extending along a moving direction of the first wedge is provided in a middle of the first wedge; the second wedge is provided with a second wedge portion facing outwards, one of the first wedge portion and the second wedge portion has a thickness gradually increasing downwards, and the other of the first wedge portion and the second wedge portion has a thickness gradually decreasing downwards.

Further, the elastic member is a compression spring, one end of the elastic member abuts against one side surface of the first locking member, and the second wedge is fixed on the other side surface of the first locking member. However, other forms of elastic members may also be adopted, for example, instead of using the compression spring, a tension spring may be used, with one end being fixed and the other end being connected to the first locking member. Further, instead of setting the second wedge separately, the second wedge may also be integrally formed with the first locking member, that is, the first locking member may be directly provided with a second wedge portion for cooperating with the first wedge.

Further, the base assembly is provided with a sleeve barrel at the pivot position between the support assembly and the base assembly, the support assembly further includes a central shaft passing through the compression spring, the second locking member, the first locking member, the second wedge and the first wedge, wherein the second locking member is fixedly connected to the sleeve barrel.

Further, the connecting mechanism includes an intermediate member and a connecting member, one end of the intermediate member is fixedly connected with the operating mechanism, the other end of the intermediate member is pivotally connected with an upper end of the connecting member, the first wedge is connected to a lower end of the connecting member, a rotation of the operating mechanism is converted into a linear movement of the connecting member through the intermediate member, and the linear movement of the connecting member drives the first wedge to move relative to the second wedge. However, other structures may be used to realize the conversion of the rotation of the operating mechanism into the linear movement of the connecting member.

Further, the support assembly further includes a supporting member, the connecting member is received in the supporting member, the first locking member is fixedly connected with a lower end of the supporting member.

Further, the operating mechanism includes an operating member fixedly connected with the interaction assembly and a rotating shaft fixedly provided on the operating member, the rotating shaft passes through an upper end of the supporting member and is then fixedly connected with the one end of the intermediate member.

Further, an upper end of the connecting member is provided with a first limiting portion and a second limiting portion; when the interaction assembly is turned to the use state, the first limiting portion abuts against the rotating shaft to prevent the interaction assembly from further rotating; when the interaction assembly is turned to the non-use state, the second limiting portion abuts against the rotating shaft to prevent the interaction assembly from further rotating. However, the limiting portions may also be set on other structures to limit the rotation of the interaction assembly.

Further, the supporting member is provided with a stopping portion; when the interaction assembly is turned to the use state, the stopping portion resists and supports the interaction assembly to prevent the interaction assembly from further rotating. The stopping portion can make the interaction assembly safer and more reliable in use, and the folding operation is simple and convenient. However, the stopping portion may also be omitted, or the stopping portion may be provided on other structures or other positions.

Further, the treadmill further includes a rotatable stopper, the rotatable stopper is rotatably connected to the supporting member, the rotatable stopper is provided with an arc protrusion, the operating member is provided with a protruding post; when the interaction assembly is turned to the use state, the rotatable stopper is rotated to cause the arc protrusion to abut against the protruding post for preventing the interaction assembly from rotating in a reverse direction. However, it is also possible to omit the rotatable stopper or to set the rotatable stopper having other structures.

Further, the supporting member includes a supporting plate and a supporting pipe, the supporting pipe is hollow, an upper end of the supporting pipe is connected with a lower end of the supporting plate, the first locking member is fixedly connected with a lower end of the supporting pipe; the connecting member includes a connecting plate and a connecting rod, an upper end of the connecting rod is connected with a lower end of the connecting plate, the first wedge is connected to a lower end of the connecting rod, the connecting rod is received in the hollow supporting pipe of the supporting member.

Further, an upper end of the supporting plate is provided with an elongated groove with an opening facing upwards, the support assembly further includes a fixing member, the fixing member is provided with an elongated groove with an opening facing downwards, the two elongated grooves are placed opposite and partially overlapped to form a through hole for the rotating shaft of the operating mechanism to pass through, the rotating shaft can rotate in the through hole. The detachable connection between the supporting plate and the fixing member can facilitate the installation of the rotating shaft being fixed with the intermediate member. However, the intermediate member and the rotating shaft may be fixed in a detachable manner, the supporting plate only needs to set a shaft hole corresponding to the rotating shaft, and the fixing member can thus be omitted. Generally speaking, the intermediate member and the rotating shaft are fixed in a non-detachable manner, which can improve the reliability of the fixing between the intermediate member and the rotating shaft.

Further, an upper end of the connecting member is provided with a pivot hole, the support assembly further includes a connecting shaft passing through the other end of the intermediate member and the pivot hole, such that the intermediate member is pivotally connected with the connecting member through the connecting shaft.

Further, in the use state, the interaction assembly has an included angle with the support assembly, and in the non-use state, the interaction assembly is flush with the support assembly; in the unfolding state, the support assembly has an included angle with the base assembly, and in the folding state, the support assembly is flush with the base assembly.

Further, the interaction assembly includes a U-shaped member, the U-shaped member includes a main body located in a middle section and two handles provided at both ends of the main body, the operating mechanism is provided on each of the two handles, there are two support assemblies which are respectively located on both sides of the base assembly; when the interaction assembly is in the non-use state and the support assembly is in the folding state, the interaction assembly and the two support assemblies surround the base assembly and are flush with the base assembly.

In the treadmill provided by the present invention, due to the linkage between the interaction assembly and the support assembly, when the interaction assembly is rotated to switch from the use state to the non-use state, the operating mechanism can drive the connecting mechanism and then the connecting mechanism drives the driving mechanism, to enable the locking mechanism to switch from the locking state to the active state, such that the support assembly can rotate relative to the base assembly. Thus, the rotation between the support assembly and the base assembly is unlocked or locked while rotating the interaction assembly, and the folding operation of the treadmill is convenient, fast, safe and reliable.

DETAILED DESCRIPTION OF PREFERRED EMBODIMENTS

Specific embodiments of the present invention will be described in further detail below in conjunction with the accompanying drawings. The following embodiments are used to illustrate the present invention, but are not used to limit the scope of the present invention.

Figure 1:
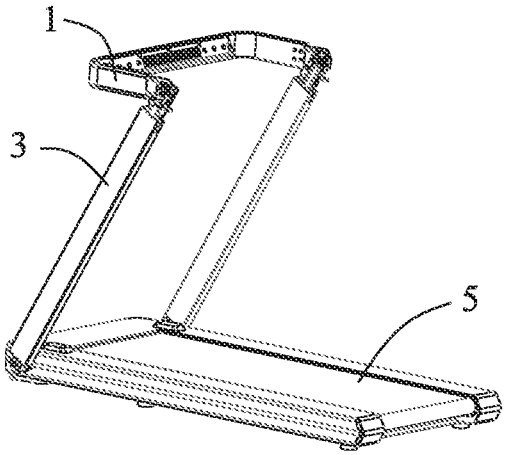
FIG. 1 is a schematic diagram of the treadmill in the first state according to the embodiment of the present invention.
Figure 2:
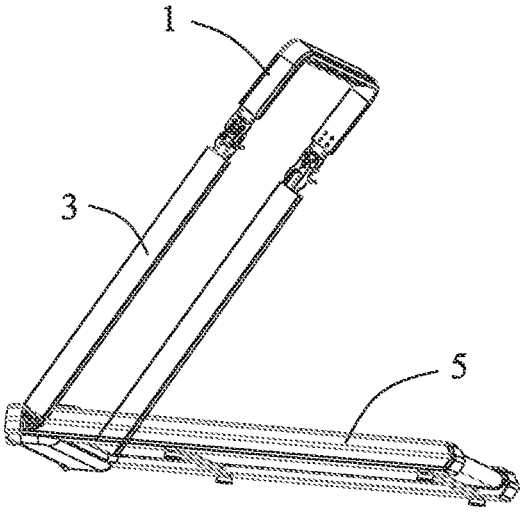
FIG. 2 is a schematic diagram of the treadmill shown in FIG. 1 in the second state.
Figure 3:
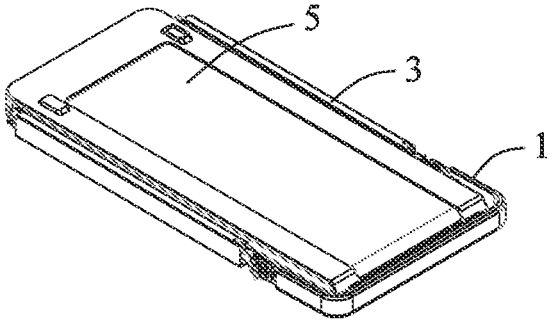
FIG. 3 is a schematic diagram of the treadmill shown in FIG. 1 in the third state.

As shown in FIGS. 1 to 3, in this embodiment, the treadmill includes an interaction assembly 1, a support assembly 3, and a base assembly 5.

The interaction assembly 1 is pivotally connected with an upper end of the support assembly 3, such that the interaction assembly 1 can rotate relative to the support assembly 3, to enable the interaction assembly 1 to switch between a use state and a non-use state. In the use state, the interaction assembly 1 has an included angle with the support assembly 3 (as shown in FIG. 1); in the non-use state, the interaction assembly 1 is flush with the support assembly 3, that is, the interaction assembly 1 and the support assembly 3 are in the same plane (as shown in FIGS. 2 and 3).

A lower end of the support assembly 3 is pivotally connected with the base assembly 5, such that the support assembly 3 can rotate relative to the base assembly 5, to enable the support assembly 3 to switch between an unfolding state and a folding state. In the unfolding state, the support assembly 3 has an included angle with the base assembly 5 (as shown in FIGS. 1 and 2); in the folding state, the support assembly 3 is flush with the base assembly 5, that is, the support assembly 3 and the base assembly 5 are in the same plane (as shown in FIG. 3).

In this embodiment, the treadmill has three states. The first state is shown in FIG. 1, wherein the interaction assembly 1 is in the use state, the support assembly 3 is in the unfolding state, and both the interaction assembly 1 and the support assembly 3 are raised up from the base assembly 5, such that the treadmill can be used for running exercise. The second state is shown in FIG. 2, which is a transition state during the folding process of the treadmill from a use state (i.e., the first state) to a non-use state (i.e., the third state). The third state is shown in FIG. 3, wherein the interaction assembly 1 is in the non-use state, the support assembly 3 is in the folding state, both the interaction assembly 1 and the support assembly 3 are folded on the base assembly 5, the interaction assembly 1 and the support assembly 3 are flush with the base assembly 5, that is, they are in the same plane, and at this time, the treadmill can be used for walking or for storage without use. After folding, the space occupied by the treadmill is small.

As shown in FIGS. 1 to 4, the interaction assembly 1 is substantially U-shaped. In this embodiment, the interaction assembly 1 is comprised of a U-shaped member 11 and a functional unit 13. The U-shaped member 11 includes a main body 111 located in the middle section and two handles 112 provided at both ends of the main body 111. The functional unit 13 is installed on the main body 111 of the U-shaped member 11. The functional unit 13 can be set with display screen, operation keys, speakers, etc. The U-shaped member 11 may be a hollow structure formed by fixing (e.g., welding) a plurality of metal sheets together. Of course, in other embodiments, the U-shaped member 11 may also have other structures so as to form the main body 111 and the two handles 112, and the functional unit 13 may also be made into an integral structure with the U-shaped member 11.

Figure 4:
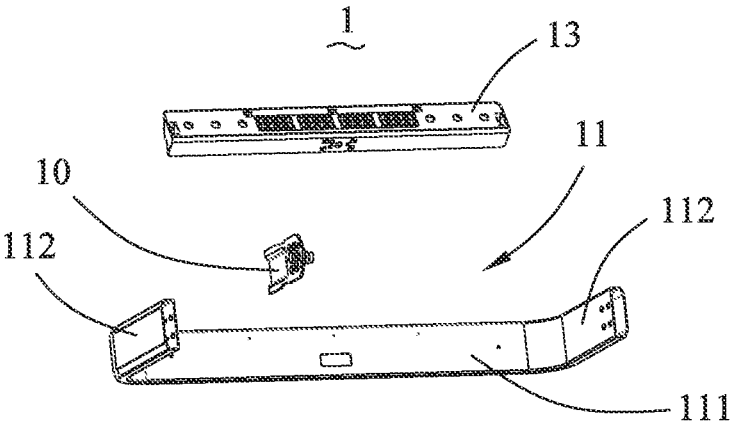
FIG. 4 is an isometric, exploded view of the interaction assembly of the treadmill shown in FIG. 1.
Figure 5:
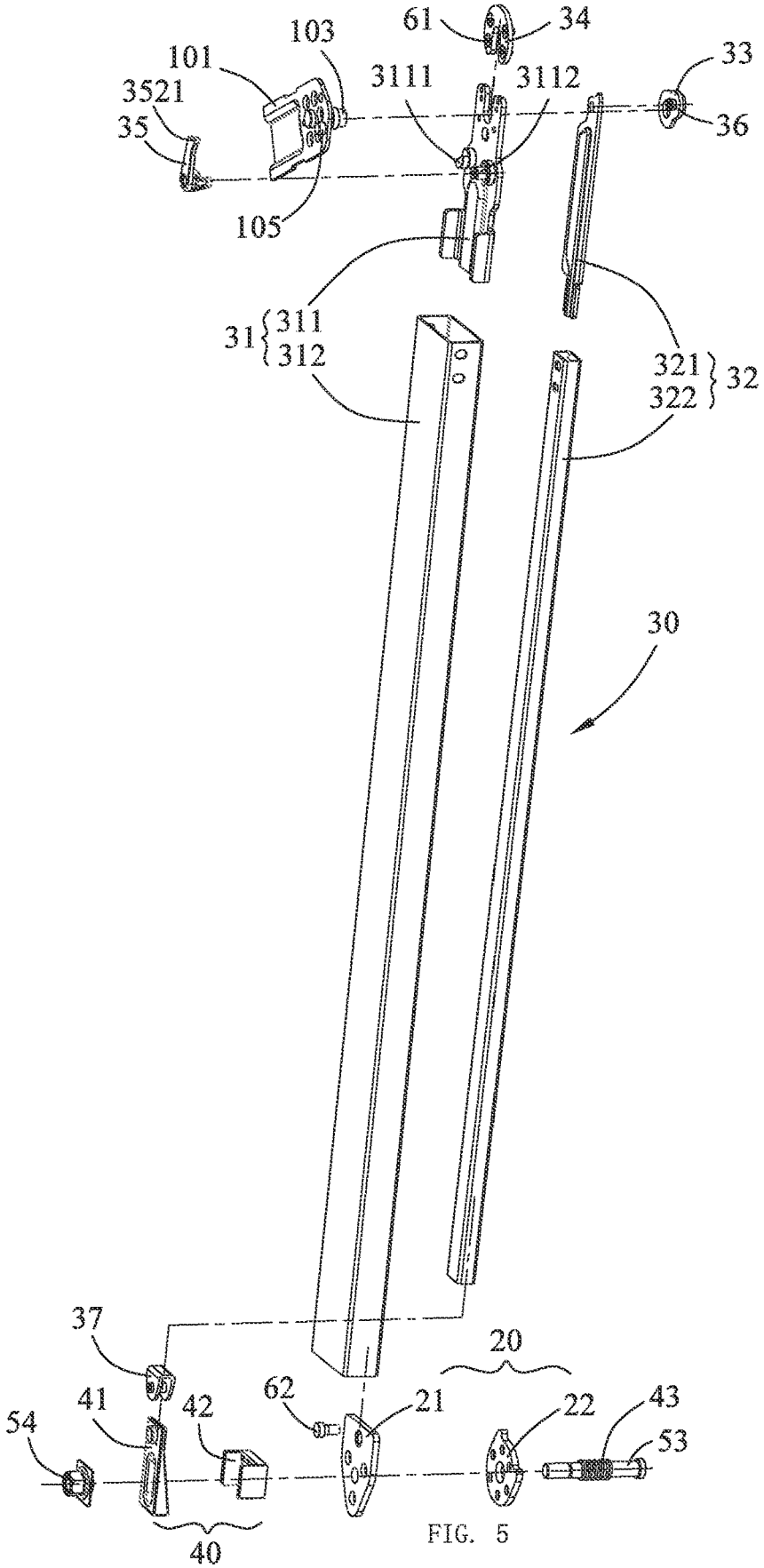
FIG. 5 is an isometric, exploded view of the support assembly and the operating mechanism of the treadmill shown in FIG. 1.
Figure 6:
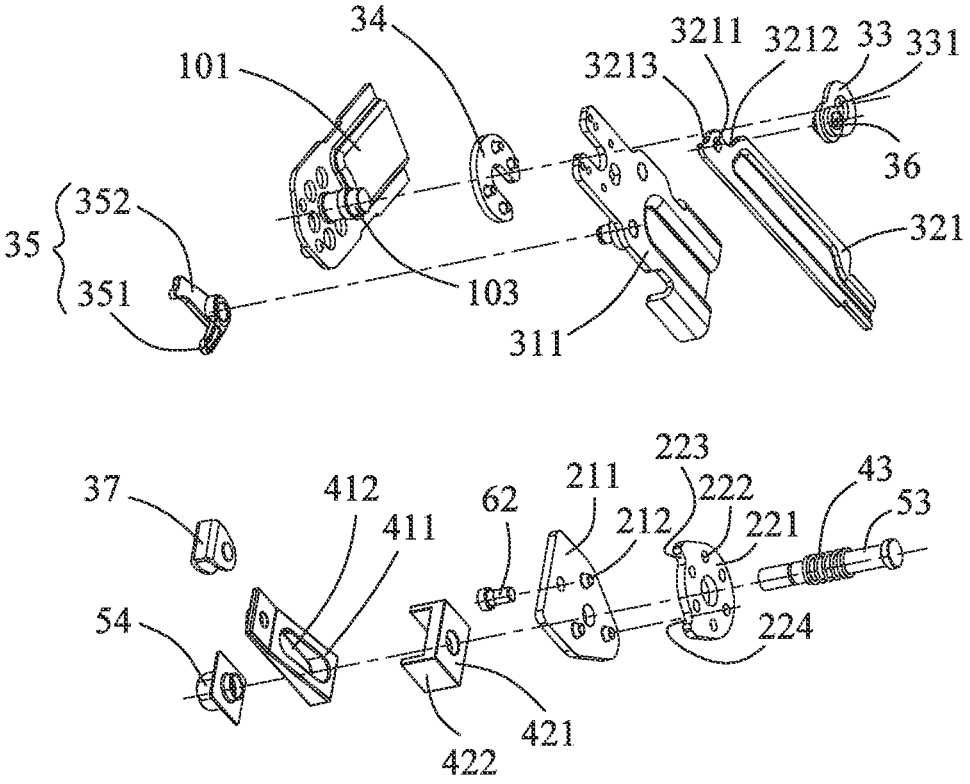
FIG. 6 is an isometric, exploded view of the support assembly and the operating mechanism of the treadmill shown in FIG. 1 from another viewing angle (some elements are omitted).

As shown in FIGS. 4 to 6, the handle 112 of the interaction assembly 1 is provided with an operating mechanism 10. The operating mechanism 10 has a plate-like operating member 101 as its main body. One end of the operating member 101 is provided with a rotating shaft 103 on an inner surface of the operating member 101 and a protruding post 105 on an outer surface of the operating member 101. The rotating shaft 103 is integrally formed or fixedly connected with the operating member 101. The other end of the operating member 101 is inserted into the hollow structure of the U-shaped member 11 from one end of the U-shaped member 11 and is fixedly connected with the U-shaped member 11.

As shown in FIGS. 5 to 14, the support assembly 3 includes a supporting member 31, a connecting member 32, an intermediate member 33, a fixing member 34, a rotatable stopper 35, a connecting shaft 36, a connecting seat 37, a first wedge 41, a second wedge 42, a compression spring 43, a first locking member 21, a second locking member 22, a limiting post 62, a center shaft 53, etc.

Figure 7:
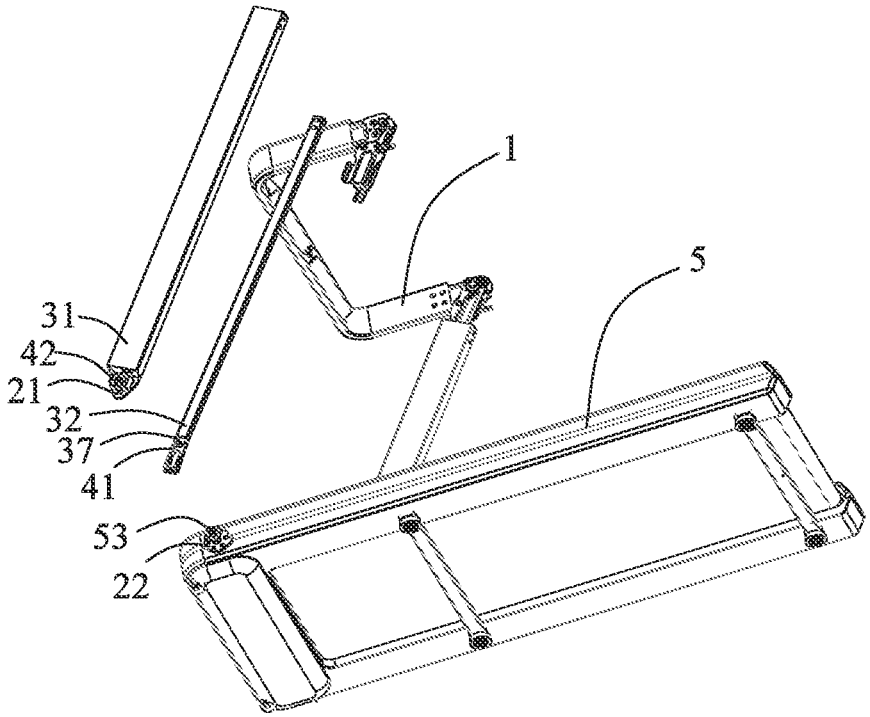
FIG. 7 is an isometric, exploded view of the treadmill shown in FIG. 1.
Figure 8:
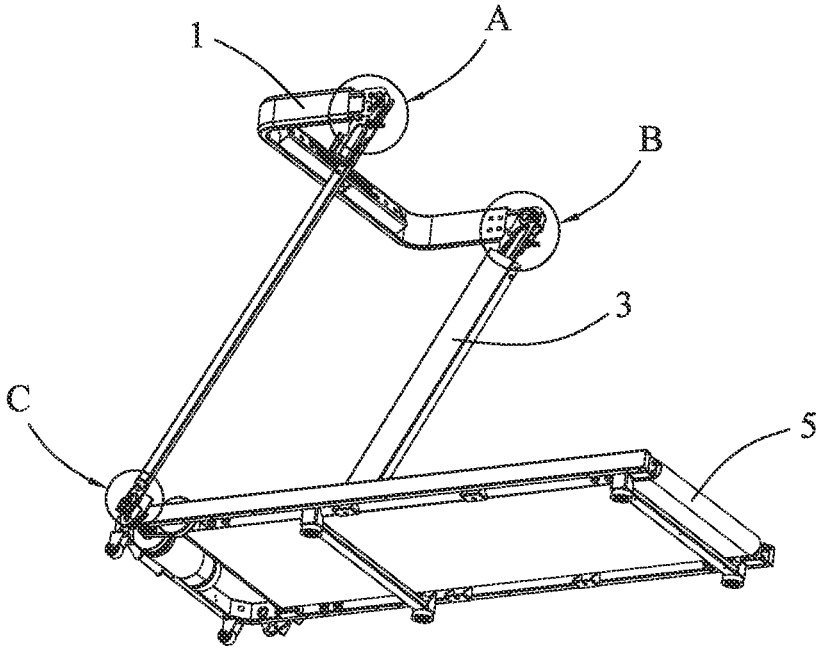
FIG. 8 is an isometric, assembled view of the treadmill shown in FIG. 1 (some elements are omitted).

The supporting member 31 includes a supporting plate 311 and a supporting pipe 312 which are fixed to each other. The supporting plate 311 is generally in the shape of a plate, and the supporting pipe 312 is hollow. The upper end of the supporting pipe 312 is fixedly connected with the lower end of the supporting plate 311, and the lower end of the supporting pipe 312 is fixedly connected with the first locking member 21 (as shown in FIG. 7).

Figure 9:
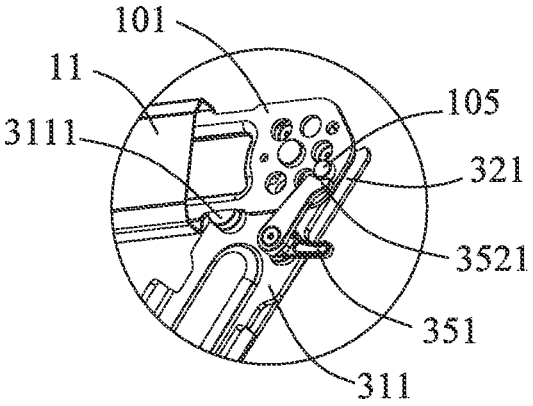
FIG. 9 is a partially enlarged view of the portion A of the treadmill shown in FIG. 8.
Figure 10:
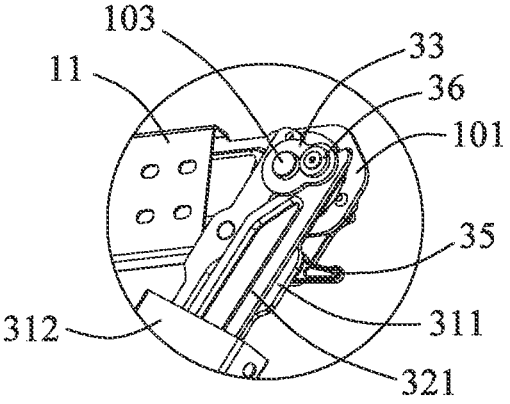
FIG. 10 is a partially enlarged view of the portion B of the treadmill shown in FIG. 8.

The upper end of the supporting plate 311 is provided with an elongated groove (not labelled) with an opening facing upwards, and the fixing member 34 is also provided with an elongated groove (not labelled) with an opening facing downwards. The two elongated grooves are placed opposite and partially overlapped to form a through hole (not labelled) for the rotating shaft 103 of the operating mechanism 10 to pass through, such that the rotating shaft 103 can rotate in the through hole. The supporting plate 311 and the fixing member 34 are fixed by a screw 61. The fixing member 34 can be detached to facilitate placing the rotating shaft 103 into the elongated groove at the upper end of the supporting plate 311. The outer surface of the middle section of the supporting plate 311 is provided with a stopping portion 3111 and a fixing seat 3112. The stopping portion 3111 has a semicircular structure. When the interaction assembly 1 is turned to the use state, the flat surface on the stopping portion 3111 resists and supports the operating member 101 of the interaction assembly 1 to prevent the interaction assembly 1 from further rotating (as shown in FIG. 9). The fixing seat 3112 is used to connect the rotatable stopper 35 such that the rotatable stopper 35 can be rotatably connected to the supporting member 31.

The rotatable stopper 35 includes a pulling portion 351 and a connecting portion 352 with a certain angle formed between them. The upper end of the connecting portion 352 is provided with an arc protrusion 3521 which corresponds to the protruding post 105 of the operating member 101. When the interaction assembly 1 is turned to the use state, the rotatable stopper 35 is rotated by operating the pulling portion 351 to cause the arc protrusion 3521 to abut against the protruding post 105 and thereby prevent the interaction assembly 1 from rotating in a reverse direction (as shown in FIG. 9).

Figure 11:
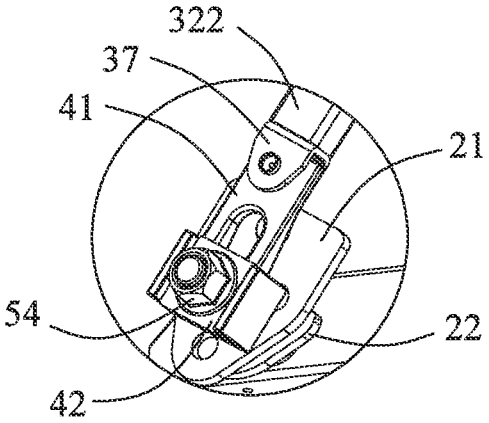
FIG. 11 is a partially enlarged view of the portion C of the treadmill shown in FIG. 8.
Figure 12:
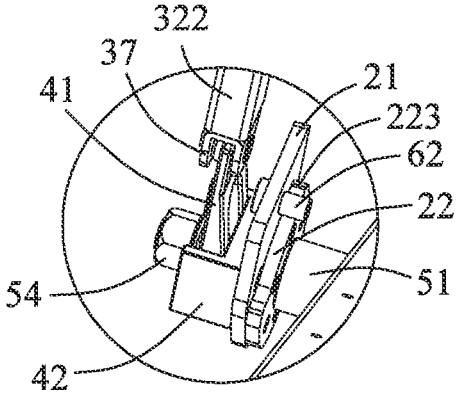
FIG. 12 is a partially enlarged view of the portion C of the treadmill shown in FIG. 8 from another viewing angle (viewed from the inside to the outside).
Figure 13:
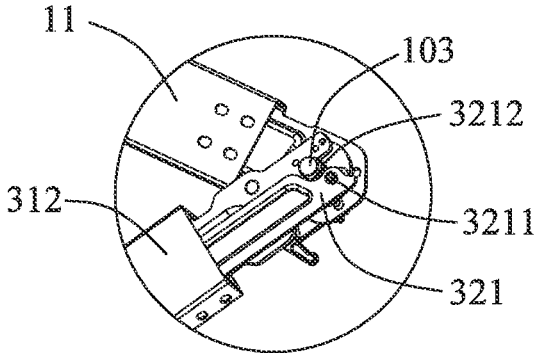
FIG. 13 is a partially enlarged view of the pivot position between the interaction assembly and the support assembly viewed from the inside to the outside when the treadmill shown in FIG. 8 is in the first state (some elements are omitted).
Figure 14:
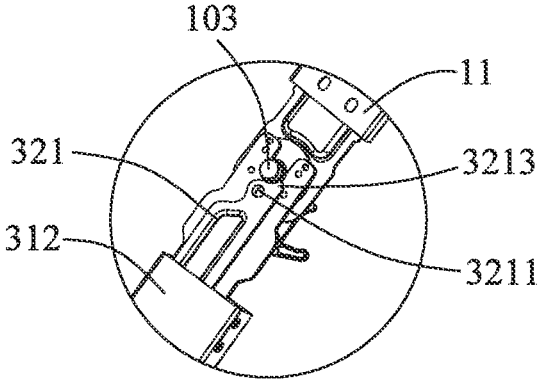
FIG. 14 is a partially enlarged view of the pivot position between the interaction assembly and the support assembly viewed from the inside to the outside when the treadmill shown in FIG. 8 is in the second state (some elements are omitted).

The connecting member 32 includes a connecting plate 321 and a connecting rod 322 which are fixed to each other. The upper end of the connecting rod 322 is connected with the lower end of the connecting plate 321 by, for example, welding, and the lower end of the connecting rod 322 is connected with the connecting seat 37 by, for example, welding. The connecting seat 37 is used to connect the first wedge 41 (as shown in FIGS. 7, 11 and 12). The connecting rod 322 is received in the hollow supporting pipe 312 of the supporting member 31. The upper end of the connecting plate 321 is provided with a pivot hole 3211, a first limiting portion 3212 and a second limiting portion 3213. When the interaction assembly 1 is turned to the use state, the first limiting portion 3212 abuts against the rotating shaft 103 to prevent the interaction assembly 1 from further rotating (as shown in FIG. 13, with the intermediate member 33 being omitted for clarity). When the interaction assembly 1 is turned to the non-use state, the second limiting portion 3213 abuts against the rotating shaft 103 to prevent the interaction assembly 1 from further rotating (as shown in FIG. 14, with the intermediate member 33 being omitted for clarity).

The intermediate member 33 is generally shaped like the number of 8, and is provided with two through holes 331. One through hole 331 is used for the rotating shaft 103 of the operating member 101 to pass through, and then the intermediate member 33 is fixed to the rotating shaft 103 by, for example, welding. The connecting shaft 36 passes through the other through hole 331 and the pivot hole 3211 of the connecting plate 321, such that the intermediate member 33 is pivotally connected with the connecting member 32 through the connecting shaft 36. When the operating member 101 is rotated, the intermediate member 33 is brought to rotate together with the operating member 101 due to the intermediate member 33 being fixedly connected with the rotating shaft 103 of the operating member 101, and the intermediate member 33 rotates with the rotating shaft 103 as its rotation center. Since the intermediate member 33 is pivotally connected with the connecting member 32 through the connecting shaft 36, as the intermediate member 33 rotates, the intermediate member 33 will drive the connecting member 32 to move linearly along the axial direction of the connecting member 32. In this way, the operating member 101, the intermediate member 33 and the connecting member 32 together forms a transmission mechanism to convert the rotation of the operating mechanism 10 into the linear movement of the connecting member 32, and to drive the first wedge 41 to move accordingly.

The first wedge 41 is connected to the connecting member 32 through the connecting seat 37. The second wedge 42 is fixed on the first locking member 21 by welding or the like. The first wedge 41 is provided with a first wedge portion 411 facing inwards and having a thickness gradually increasing downwards, and an elongated slot 412 extending along the moving direction of the first wedge 41 is provided in the middle of the first wedge 41. The second wedge 42 is provided with a second wedge portion 421 facing outwards and having a thickness gradually decreasing downwards, and two side walls 422 are formed by extending outwards from two opposite sides of the second wedge portion 421. A through hole (not labelled) is provided in the middle of the second wedge portion 421. The second wedge portion 421 and the two side walls 422 cooperatively form a guide groove for the first wedge 41 to move in the guide groove.

In this embodiment, the first locking member 21 is provided on the support assembly 3, the second locking member 22 is provided on the base assembly 5. In the active state, the first locking member 21 is unlocked with the second locking member 22 such that the support assembly 3 can rotate relative to the base assembly 5, while in the locking state, the first locking member 21 is locked with the second locking member 22 such that the support assembly 3 cannot rotate relative to the base assembly 5. For example, one of the first locking member 21 and the second locking member 22 may be provided with at least one protrusion 212, the other of the first locking member 21 and the second locking member 22 may be provided with at least one insertion hole 222, the at least one protrusion 212 corresponds to the at least one insertion hole 222 to form a concave-convex matching structure. In the active state, the at least one protrusion 212 is disengaged from the at least one insertion hole 222 such that the first locking member 21 is unlocked with the second locking member 22, while in the locking state, the at least one protrusion 212 is engaged in the at least one insertion hole 222 such that the first locking member 21 is locked with the second locking member 22.

Figure 15:
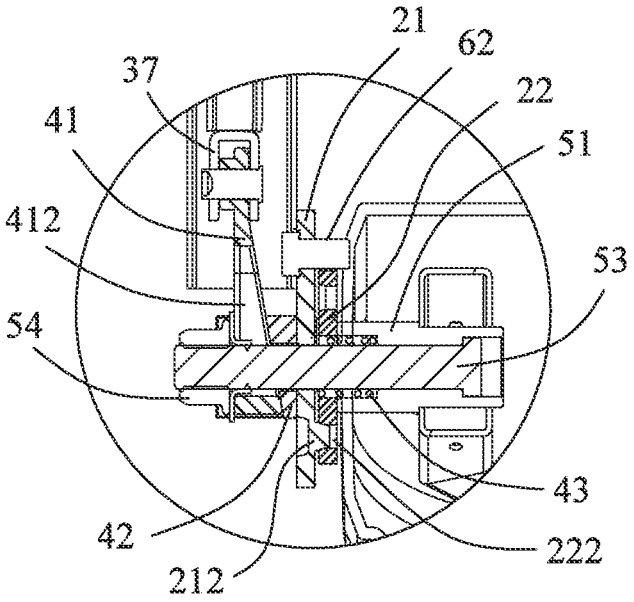
FIG. 15 is a cross-sectional view of the pivot position between the support assembly and the base assembly when the treadmill shown in FIG. 8 is in the first state.

Specifically, in this embodiment, the first locking member 21 is in a plate shape, including a first plate body 211 and a plurality of protrusions 212 (three in this embodiment) provided on the inner surface of the first plate body 211. The middle of the first plate body 211 is provided with a through hole (not labelled), and the upper end of the first plate body 211 is fixedly provided with a limiting post 62. The second locking member 22 is also in a plate shape, including a second plate body 221. The middle of the second plate body 221 is also provided with a through hole (not labelled), and a plurality of insertion holes 222 (six in this embodiment) are provided in the second plate body 221 around the through hole. The protrusion 212 and the insertion hole 222 cooperatively form a concave-convex matching structure. When the treadmill is in the use state, the protrusion 212 is inserted into the insertion hole 222, and the first locking member 21 and the second locking member 22 are in a fixed state so as to prevent the support assembly 3 from rotating relative to the base assembly 5 (as shown in FIG. 15). Two sides of the upper end of the second plate body 221 are provided with a first limiting block 223 and a second limiting block 224. The limiting post 62 cooperates with the first limiting block 223 and the second limiting block 224 to limit the rotation range of the support assembly 3 relative to the base assembly 5, such that the support assembly 3 can only rotate and switch between the unfolding state and the folding state.

The compression spring 43 is used to exert a biasing force on the first locking member 21 so as to push the first locking member 21 outwards away from the second locking member 22. However, in other embodiments, instead of the compression spring 43, other forms of elastic members may also be used so long as the elastic member can exert a biasing force on the first locking member 21. When the first wedge 41 is driven to move in a first direction (e.g., downwards) relative to the second wedge 42, the biasing force drives the first locking member 21 to move away from the second locking member 22 such that the first locking member 21 is unlocked with the second locking member 22, while when the first wedge 41 is driven to move in an opposite second direction (e.g., upwards) relative to the second wedge 42, the first wedge 41 drives the second wedge 42 and the first locking member 21 to move towards the second locking member 22 such that the first locking member 21 is locked with the second locking member 22.

The base assembly 5 is provided with a sleeve barrel 51 at the pivot position between the support assembly 3 and the base assembly 5. The sleeve barrel 51 extends outwards from the base assembly 5. The second locking member 22 is fixed to the outer end of the sleeve barrel 51 by, for example, welding. The compression spring 43 is placed inside the sleeve barrel 51. The central shaft 53 sequentially passes through the middle of the compression spring 43, the through hole of the second locking member 22, the through hole of the first locking member 21, the through hole of the second wedge 42 and the elongated slot 412 of the first wedge 41, and finally the distal end of the central shaft 53 is fixed with a nut 54.

Figure 16:
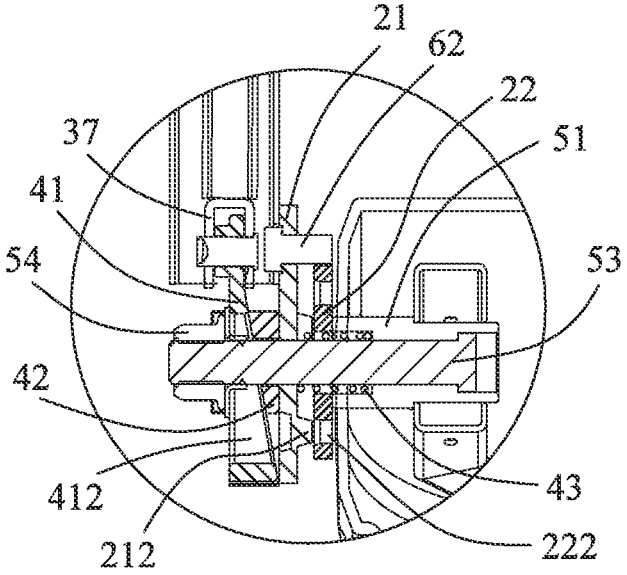
FIG. 16 is a sectional view of the pivot position between the support assembly and the base assembly when the treadmill shown in FIG. 8 is in the second state.

FIGS. 13 to 16 are used to describe the positional relationship between relevant components when the interaction assembly 1 is transferred between the use state and the non-use state. When the interaction assembly 1 is transferred from the use state to the non-use state, the operating member 101 drives the connecting member 32 to move downward through the intermediate member 33, and the connecting member 32 then drives the first wedge 41 to move downward. At this time, under the push of the compression spring 43, the first locking member 21 and the second wedge 42 move outward away from the second locking member 22, the protrusion 212 of the first locking member 21 is separated and disengaged from the insertion hole 222 of the second locking member 22 (as shown in FIG. 16), such that the first locking member 21 is in an active state relative to the second locking member 22, and at this time, the support assembly 3 can rotate relative to the base assembly 5, that is, the support assembly 3 is in an unlocked state. On the contrary, when the interaction assembly 1 is transferred from the non-use state to the use state, the operating member 101 drives the connecting member 32 to move upward through the intermediate member 33, and the connecting member 32 then drives the first wedge 41 to move upward. At this time, under the push of the first wedge 41, the second wedge 42 and the first locking member 21 move inward towards the second locking member 22, the protrusion 212 of the first locking member 21 is inserted into the insertion hole 222 of the second locking member 22 to form engagement (as shown in FIG. 15), such that the first locking member 21 is in a locking state being locked with the second locking member 22, and at this time, the support assembly 3 cannot rotate relative to the base assembly 5, that is, the support assembly 3 is in a locked state.

In other embodiments, the first wedge 41 may also be provided with a first wedge portion facing inwards and having a thickness gradually decreasing downwards, while the second wedge 42 is provided with a second wedge portion facing outwards and having a thickness gradually increasing downwards. At the same time, in the process of changing the interaction assembly 1 from the use state to the non-use state, the operating member 10 is configured to drive the connecting member 32 and the first wedge 41 to move upward through the intermediate member 33. In this situation, the first locking member 21 and the second wedge 42 will also move outward away from the second locking member 22 under the push of the compression spring 43 when the interaction assembly 1 is transferred from the use state to the non-use state, and the protrusion 212 is separated and disengaged from the insertion hole 222 to realize the unlocking between the support assembly 3 and the base assembly 5. On the contrary, when the interaction assembly 1 is transferred from the non-use state to the use state, the operating member 10 will drive the connecting member 32 and the first wedge 41 to move downward through the intermediate member 33, the second wedge 42 and the first locking member 21 will also move inward towards the second locking member 22 under the push of the first wedge 41, and the protrusion 212 is inserted into the insertion hole 222 to form engagement to realize the locking between the support assembly 3 and the base assembly 5.

In this embodiment, the first locking member 21 and the second locking member 22 form a locking mechanism 20. The locking mechanism 20 is provided at a pivot position between the support assembly 3 and the base assembly 5, wherein the first locking member 21 is provided on the support assembly 3, and the second locking member 22 is provided on the base assembly 5. The locking mechanism 20 can switch between an active state and a locking state. In the active state, the support assembly 3 can rotate relative to the base assembly 5, and in the locking state, the support assembly 3 cannot rotate relative to the base assembly 5, so as to realize unlocking or locking of the rotation between the support assembly 3 and the base assembly 5.

In this embodiment, the connecting member 32, the intermediate member 33 and the connecting seat 37 form a connecting mechanism 30. The first wedge 41, the second wedge 42 and the compression spring 43 form a driving mechanism 40. The operating mechanism 10, the connecting mechanism 30 and the driving mechanism 40 are connected sequentially to form a linkage, wherein the operating mechanism 10 is provided on the interaction assembly 1, the connecting mechanism 30 is provided on the support assembly 3, and the driving mechanism 40 is provided at the pivot position between the support assembly 3 and the base assembly 5. When the interaction assembly 1 is rotated to switch from the use state to the non-use state, the connecting mechanism 30 is driven by the operating mechanism 10, and then the driving mechanism 40 is driven by the connecting mechanism 30, to enable the locking mechanism 20 to switch from the locking state to the active state, such that the support assembly 3 can rotate relative to the base assembly 5. In this way, the linkage between the interaction assembly 1 and the support assembly 3 is realized, thereby making the operation simple, fast, safe and reliable. It is understood that, in other embodiments, the connecting seat 37 may also be omitted, that is, the first wedge 41 is directly connected to the lower end of the connecting rod 322.

The interaction assembly 1, the supporting pipe 312 and the base assembly 5 constitute the main contour of the treadmill. Protective elements (such as corrugated rubber tubes) can be added to the pivot positions between the interaction assembly 1 and the supporting pipe 312 and between the supporting pipe 312 and the base assembly 5 to protect the various components at the two pivot positions. It should be noted that the pulling portion 351 of the rotatable stopper 35 needs to be exposed outside in order for easy operation.

Of course, in other embodiments, the operating mechanism 10, the connecting mechanism 30, the driving mechanism 40 and the locking mechanism 20 can adopt other different structures. As long as the interaction assembly 1 is rotated to switch from the use state to the non-use state, the linkage between the interaction assembly 1 and the support assembly 3 can be realized, That is, the operating mechanism 10 can drive the connecting mechanism 30 and then the connecting mechanism 30 drives the driving mechanism 40, to enable the locking mechanism 20 to switch from the locking state to the active state, such that the support assembly 3 can rotate relative to the base assembly 5, the operation is simple, fast, safe and reliable.

As can be seen from the above description, by the linkage between the interaction assembly 1 and the support assembly 3, when the interaction assembly 1 is rotated to switch from the use state to the non-use state, the operating mechanism 10 can drive the connecting mechanism 30 and then the connecting mechanism 30 drives the driving mechanism 40, to enable the locking mechanism 20 to switch from the locking state to the active state, such that the support assembly 3 can rotate relative to the base assembly 5. Thus, the rotation between the support assembly 3 and the base assembly 5 is unlocked or locked while rotating the interaction assembly 1, and the folding operation of the treadmill is convenient, fast, safe and reliable.

In this description, the azimuth or positional relationship indicated by the terms "up", "down", "front", "back", "left", "right", "top", "bottom", "inside", "outside", "vertical", "horizontal" is based on the azimuth or positional relationship shown in the accompanying drawings, only for the sake of clarity and convenience of description of the technical solution. Therefore, it cannot be understood as a limitation of the present invention.

In this description, the terms "first", "second", "third" and the like are only used to distinguish elements from each other, and cannot be understood as indicating or implying specific order or relative importance.

In this description, the terms "include", "comprise", or any other variation thereof are intended to cover non-exclusive inclusion, including not only those elements listed, but also other elements not explicitly listed.

The above is only the specific embodiments of the present invention, but the protection scope of the present invention is not limited to this. Any person skilled in the technical field can easily think of changes or replacements within the technical scope disclosed by the present invention, which should be covered by the protection scope of the present invention. Therefore, the protection scope of the present invention shall be defined by the appended claims.

What is claimed is:

1. A treadmill comprising an interaction assembly, a support assembly and a base assembly;

wherein the interaction assembly is pivotally connected with an upper end of the support assembly such that the interaction assembly can rotate relative to the support assembly and switch between a use state and a non-use state;

a lower end of the support assembly is pivotally connected with the base assembly such that the support assembly can rotate relative to the base assembly and switch between an unfolding state and a folding state;

a locking mechanism is provided at a pivot position between the support assembly and the base assembly, the locking mechanism can switch between an active state and a locking state; in the active state, the support assembly can rotate relative to the base assembly, and in the locking state, the support assembly cannot rotate relative to the base assembly;

the treadmill is provided with an operating mechanism, a connecting mechanism and a driving mechanism which are connected sequentially, the operating mechanism is provided on the interaction assembly, the connecting mechanism is provided on the support assembly, the driving mechanism is provided at a pivot position between the support assembly and the base assembly;

when the interaction assembly is rotated to switch from the use state to the non-use state, the connecting mechanism is driven by the operating mechanism and then the driving mechanism is driven by the connecting mechanism, so as to cause the locking mechanism to switch from the locking state to the active state;

the locking mechanism comprises a first locking member and a second locking member, the first locking member is provided on the support assembly, the second locking member is provided on the base assembly; in the active state, the first locking member is unlocked with the second locking member such that the support assembly can rotate relative to the base assembly; in the locking state, the first locking member is locked with the second locking member such that the support assembly cannot rotate relative to the base assembly;

the first locking member and the second locking member are provided with a concave-convex matching structure; in the active state, the first locking member is located far away from the second locking member and the concave-convex matching structure is disengaged from each other such that the first locking member is unlocked with the second locking member; in the locking state, the first locking member is located close to the second locking member and the concave-convex matching structure is engaged with each other such that the first locking member is locked with the second locking member.

2. The treadmill according to claim 1, wherein one of the first locking member and the second locking member is provided with at least one protrusion, the other of the first locking member and the second locking member is provided with at least one insertion hole, the at least one protrusion corresponds to the at least one insertion hole to form the concave-convex matching structure; in the active state, the at least one protrusion is disengaged from the at least one insertion hole such that the first locking member is unlocked with the second locking member; in the locking state, the at least one protrusion is engaged in the at least one insertion hole such that the first locking member is locked with the second locking member.

3. The treadmill according to claim 1, wherein the first locking member comprises a first plate body, the first plate body is provided with a limiting post, the second locking member comprises a second plate body, the second plate body is provided with a first limiting block and a second limiting block, the limiting post is cooperated with the first limiting block and the second limiting block to limit a rotation range of the support assembly relative to the base assembly, such that the support assembly can only rotate and switch between the unfolding state and the folding state.

4. The treadmill according to claim 1, wherein the driving mechanism comprises an elastic member, a first wedge and a second wedge for cooperating with the first wedge, the first wedge is connected to and driven by the connecting mechanism to move together with the connecting mechanism, the second wedge is fixed on the first locking member, the elastic member is configured to exert a biasing force on the first locking member; when the first wedge is driven to move in a first direction relative to the second wedge, the biasing force drives the first locking member to move away from the second locking member such that the first locking member is unlocked with the second locking member; when the first wedge is driven to move in an opposite second direction relative to the second wedge, the first wedge drives the second wedge and the first locking member to move towards the second locking member such that the first locking member is locked with the second locking member.

5. The treadmill according to claim 4, wherein the first wedge is provided with a first wedge portion facing inwards, an elongated slot extending along a moving direction of the first wedge is provided in a middle of the first wedge; the second wedge is provided with a second wedge portion facing outwards, one of the first wedge portion and the second wedge portion has a thickness gradually increasing downwards, and the other of the first wedge portion and the second wedge portion has a thickness gradually decreasing downwards.

6. The treadmill according to claim 4, wherein the elastic member is a compression spring, one end of the elastic member abuts against one side surface of the first locking member, and the second wedge is fixed on the other side surface of the first locking member.

7. The treadmill according to claim 6, wherein the base assembly is provided with a sleeve barrel at the pivot position between the support assembly and the base assembly, the support assembly further comprises a central shaft passing through the compression spring, the second locking member, the first locking member, the second wedge and the first wedge, wherein the second locking member is fixedly connected to the sleeve barrel.

8. The treadmill according to claim 4, wherein the connecting mechanism comprises an intermediate member and a connecting member, one end of the intermediate member is fixedly connected with the operating mechanism, the other end of the intermediate member is pivotally connected with an upper end of the connecting member, the first wedge is connected to a lower end of the connecting member, a rotation of the operating mechanism is converted into a linear movement of the connecting member through the intermediate member, and the linear movement of the connecting member drives the first wedge to move relative to the second wedge.

9. The treadmill according to claim 8, wherein the support assembly further comprises a supporting member, the connecting member is received in the supporting member, the first locking member is fixedly connected with a lower end of the supporting member.

10. The treadmill according to claim 9, wherein the operating mechanism comprises an operating member fixedly connected with the interaction assembly and a rotating shaft fixedly provided on the operating member, the rotating shaft passes through an upper end of the supporting member and is then fixedly connected with the one end of the intermediate member.

11. The treadmill according to claim 10, wherein an upper end of the connecting member is provided with a first limiting portion and a second limiting portion; when the interaction assembly is turned to the use state, the first limiting portion abuts against the rotating shaft to prevent the interaction assembly from further rotating; when the interaction assembly is turned to the non-use state, the second limiting portion abuts against the rotating shaft to prevent the interaction assembly from further rotating.

12. The treadmill according to claim 10, wherein the supporting member is provided with a stopping portion; when the interaction assembly is turned to the use state, the stopping portion resists and supports the interaction assembly to prevent the interaction assembly from further rotating.

13. The treadmill according to claim 10, wherein the treadmill further comprises a rotatable stopper, the rotatable stopper is rotatably connected to the supporting member, the rotatable stopper is provided with an arc protrusion, the operating member is provided with a protruding post; when the interaction assembly is turned to the use state, the rotatable stopper is rotated to cause the arc protrusion to abut against the protruding post for preventing the interaction assembly from rotating in a reverse direction.

14. The treadmill according to claim 10, wherein the supporting member comprises a supporting plate and a supporting pipe; the supporting pipe is hollow; an upper end of the supporting pipe is connected with a lower end of the supporting plate, the first locking member is fixedly connected with a lower end of the supporting pipe; the connecting member comprises a connecting plate and a connecting rod, an upper end of the connecting rod is connected with a lower end of the connecting plate, the first wedge is connected to a lower end of the connecting rod, the connecting rod is received in the hollow supporting pipe of the supporting member.

15. The treadmill according to claim 14, wherein an upper end of the supporting plate is provided with an elongated groove with an opening facing upwards, the support assembly further comprises a fixing member, the fixing member is provided with an elongated groove with an opening facing downwards, the two elongated grooves are placed opposite and partially overlapped to form a through hole for the rotating shaft of the operating mechanism to pass through, the rotating shaft can rotate in the through hole.

16. The treadmill according to claim 8, wherein an upper end of the connecting member is provided with a pivot hole, the support assembly further comprises a connecting shaft passing through the other end of the intermediate member and the pivot hole, such that the intermediate member is pivotally connected with the connecting member through the connecting shaft.

17. The treadmill according to claim 1, wherein in the use state, the interaction assembly has an included angle with the support assembly, and in the non-use state, the interaction assembly is flush with the support assembly; in the unfolding state, the support assembly has an included angle with the base assembly, and in the folding state, the support assembly is flush with the base assembly.

18. The treadmill according to claim 1, wherein the interaction assembly comprises a U-shaped member, the U-shaped member comprises a main body located in a middle section and two handles provided at both ends of the main body, the operating mechanism is provided on each of the two handles, there are two support assemblies which are respectively located on both sides of the base assembly; when the interaction assembly is in the non-use state and the support assembly is in the folding state, the interaction assembly and the two support assemblies surround the base assembly and are flush with the base assembly.

* * * * *